US006610158B2

(12) United States Patent
Lanza Rivas et al.

(10) Patent No.: US 6,610,158 B2
(45) Date of Patent: Aug. 26, 2003

(54) PROCEDURE AND INSTALLATION FOR ON-SITE MANUFACTURING OF EXPLOSIVES MADE FROM A WATER BASED OXIDIZING PRODUCT

(75) Inventors: Rafael Lanza Rivas, Las Arenas (ES); José Ramón Quintana Angulo, Getxo (ES); Fernando María Beitia Gomez De Segura, Murguia (ES)

(73) Assignee: Union Espanola de Explosivos, S.A., Madrid (ES)

( * ) Notice: Subject to any disclaimer, the term of this patent is extended or adjusted under 35 U.S.C. 154(b) by 0 days.

(21) Appl. No.: 10/041,335

(22) Filed: Jan. 8, 2002

(65) Prior Publication Data

US 2002/0129881 A1 Sep. 19, 2002

Related U.S. Application Data

(63) Continuation of application No. PCT/ES99/00224, filed on Jul. 9, 1999.

(51) Int. Cl.[7] ..... D03D 23/00; F42D 3/00

(52) U.S. Cl. ..... 149/109.6; 102/313

(58) Field of Search ..... 149/60, 108.8, 149/109.6; 102/313, 289; 86/20.15

(56) References Cited

U.S. PATENT DOCUMENTS

| | | | | |
|---|---|---|---|---|
| 3,303,738 A | | 2/1967 | Clay et al. | |
| 3,338,033 A | | 8/1967 | Ross | |
| 3,400,026 A | | 9/1968 | Fearnow | |
| 3,507,718 A | * | 4/1970 | Mortenson et al. | 149/3 |
| 3,582,411 A | | 6/1971 | Brockbank et al. | |
| 3,610,088 A | | 10/1971 | Clay et al. | |
| 3,678,140 A | | 7/1972 | Adams et al. | |
| 3,706,607 A | | 12/1972 | Chrisp | |
| 3,711,345 A | | 1/1973 | Tomic | |
| 3,713,919 A | | 1/1973 | Tomic | |
| 3,770,522 A | | 11/1973 | Tomic | |
| 3,790,415 A | | 2/1974 | Tomic | |
| 3,886,010 A | | 5/1975 | Thornley et al. | |
| 4,008,108 A | | 2/1977 | Chrisp | |
| 4,555,278 A | | 11/1985 | Cescon et al. | |
| 4,966,077 A | * | 10/1990 | Halliday et al. | 102/313 |
| 5,490,887 A | * | 2/1996 | Cranney et al. | 149/2 |
| 5,500,062 A | * | 3/1996 | Chattopadhyay | 149/46 |

FOREIGN PATENT DOCUMENTS

| | | |
|---|---|---|
| EP | 0194775 | 9/1986 |
| EP | 0203230 | 12/1986 |
| GB | 1215378 | * 12/1970 |
| WO | WO 99/00342 | 1/1999 |

* cited by examiner

*Primary Examiner*—Michael J. Carone
*Assistant Examiner*—Aileen B. Felton
(74) *Attorney, Agent, or Firm*—John C. McMahon

(57) ABSTRACT

The procedure involves the mixture of a water based oxidizing product with an oxygen balance greater than 14% consisting of a water solution saturated with oxidizing salts, oxidizing particles in suspension and thickening agents, with a fuel and a gas in a mixer, by means of the formation of an intimate mixture of the oxidizing product and the fuel and the formation of a suspension or emulsion of gas in the mixture. The density of the end explosive product may be varied according to the gas flow and this is controlled before introducing the explosive into the bore. The installation consists of a tank (1) with the oxidizing product, a fuel tank (11), a gas reserve (10), a mixer (5), a pump (3), a dosing device for the fuel (12) with a flow meter (13) and a regulating device of the gas flow (8), and, optionally, a tank (2) with a stabilizer of the gas bubbles, a dosing pump (4) and a flow meter (7).

17 Claims, 1 Drawing Sheet

PROCEDURE AND INSTALLATION FOR ON-SITE MANUFACTURING OF EXPLOSIVES MADE FROM A WATER BASED OXIDIZING PRODUCT

This is a continuation of PCT/ES9900224.

FIELD OF THE INVENTION

The present invention refers to a procedure and an installation for on-site manufacturing of explosives by means of incorporating fuel and gas into an oxidant water based product with formation of emulsion or dispersion of the fuel and the gas in the liquid mixture.

BACKGROUND OF THE INVENTION

The initiation mechanism of explosives by means of generation of hot points due to the adiabatic compression of gas bubbles is the basis of modern industrial explosives formulated without components that are intrinsically explosive.

The introduction of gas bubbles can be done either by entrapment during the mixture or by its formation by means of a chemical reaction. U.S. Pat. No. 3,400,026 describes a formulation that employs protein in dissolution (albumin, collagen, soy protein, etc.) to favor the formation of bubbles and their stabilization. U.S. Pat. No. 3,582,411 describes a formulation of explosive hydrogel that contains a foam promoting agent of the guar gum type modified with hydroxyl groups.

U.S. Pat. No. 3,678,140 describes a process for the incorporation of air by means of the use of protein solutions, making the composition pass through a series of openings at pressures of 40 to 160 psi and simultaneously introducing air by means of eductors.

The incorporation of gas bubbles by means of their generation as a result of a chemical reaction is described in U.S. Pat. Nos. 3,706,607, 3,711,345, 3,713,919, 3,770,522, 3,790,415 and 3,886,010.

Regarding the on-site manufacture of explosives, that is, in the truck itself which is used for pumping the explosives into the bores, the first patents are from IRECO, as described in U.S. Pat. Nos. 3,303,738 and 3,338,033. These patents are characterized by the manufacturing in the truck of an explosive of the hydrogel type by means of the dosing and mixture of a liquid solution of oxidizing salts with a solid material that contains oxidizing salts and thickeners. In U.S. Pat. No. 3,610,088 (IRECO) they use the same method as the previous patents for the on-site forming of the hydrogel and they incorporate the simultaneous addition of air either by means of mechanical entrapment or their generation by means of a chemical reaction. EP Patent 0 203 230 (IRECO) describes a mixer consisting of moveable and fixed blades which allow an on-site manufacturing of a blasting agent of the water emulsion in oil type. The sensitization of this emulsion is accomplished by adding low density particles (oxidants or hollow microspheres).

The on-site manufacturing of the explosive has as its main advantage a decrease of risk during its transportation. However, it is necessary to have a very sophisticated mobile installation with complex processes for manufacturing and control, due to the use of oxidizing salts at high temperatures, dosing of solids and mixtures of liquids and solids.

Another alternative is the transportation of the finished product without sufficient sensitizing, that is, at a density such that it does not have the capacity to propagate a stable detonation. In this context in recent years it has become common to transport the matrix product and produce its sensitization at the mine either by means of mixing it with low density particulated nitrates or mixtures of ammonium nitrate with hydrocarbide (ANFO) or by means of the generation of bubbles from a chemical reaction. U.S. Pat. No. 4,555,278 describes an explosive of this type manufactured by a mixture of emulsion and ANFO. European Patent EP 0 194 775 describes an explosive of the previous type, made from a hydrogel matrix.

The sensitization of the matrix emulsion by means of gas bubble generation from a chemical reaction is presently the most widespread method. However, to avoid the coalescence of the gas bubbles, as described in U.S. Pat. No. 4,008,108, the pumping and the manipulation of the emulsion must be performed before the gasification reaction occurs. This method thus presents the disadvantage of having to wait a certain amount of time after filling the bores until reaching the final density, not having the capacity to maneuver if the obtained density does not coincide with what is expected, possibly causing sensitization failures or an incorrect dispersion of explosive in the bore column.

Patent application WO 99/00342, in the name of UNIÓN ESPAÑOLA DE EXPLOSIVOS, S.A., claims a process for the sensitizing of water based explosives before loading the bores, from a non-explosive matrix consisting of oxidants and fuels, by means of the formation of an emulsion or dispersion of gas in said matrix. The density control is performed before loading the bore, regulating the flow of gas that is injected.

Although the transport of a matrix product and its on-site sensitization supposes a large advance from the safety point of view compared to the transportation of the already sensitized product, there are various experiences of accidents in which a detonation of a non-sensitized matrix product has occurred as a consequence of an inadequate manipulation or by the effect of a prolonged fire. For this reason, in some countries, such as Australia, a new denomination has been created for matrices of mixtures of oxidants and reductants known as explosive precursors. Although these types of products are classified for transportation as oxidants 5.1, they must be manufactured in facilities that have the safety measures, distances, etc., of an explosive manufacturing plant.

SUMMARY OF THE INVENTION

The present invention eliminates the transportation of explosives or mixtures of oxidants and reductants commonly known as matrices or explosive precursors, by means of the on-site manufacture of the explosive, that is, at the place of use, without the inconveniences that this process presented until now (complex installations, difficult handling of intermediary products, complex processes, etc.). The invention consists of the manufacture within the industrial area of a suspension of oxidizing salts in a water solution saturated with oxidizing salts, stabilized by means of a thickener preferably of inorganic origin that will allow to maintain the oxidant particles dispersed in a homogenized manner. In the event of using organic thickeners, the percentage of it is sufficiently small so that said suspension may be considered as an oxidant suspension.

According to the present invention, the manufacture and sensitization of the explosive is performed on-site, by means of an intimate mixture of said stable oxidant dispersion at room temperature, with a fuel and a gas in a mixer, causing the formation of a suspension or emulsion of gas in liquid. The density of the end explosive product may be varied as a function of the volume of gas and this is controlled before introducing it into the bore.

DETAILED DESCRIPTION OF THE INVENTION

Figure 1:
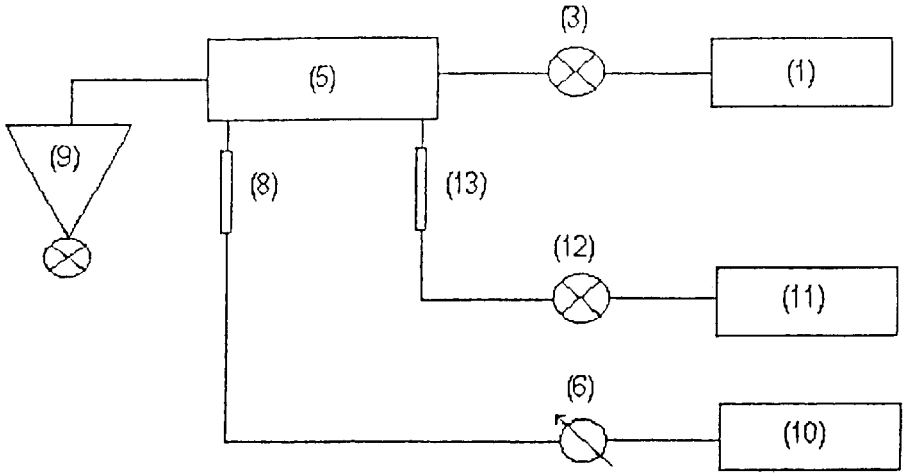
FIG. 1 shows a schematic of a particular embodiment of an installation for the on-site manufacturing of a water based explosive provided by this invention.

The invention provides a process for the on-site manufacturing of water based explosives, made from a water based oxidant product that consists of the following:

a) the transport of a water based oxidant product that has an oxygen balance higher than 14%, and it is composed of a water solution saturated with oxidizing salts, particles of oxidizing salts in suspension and thickening agents; and b) the manufacture and sensitization of the explosive before loading it into the bores, mixing said water based oxidant product with a fuel and a gas in a mixer, attaining the formation of an intimate mixture of the water based oxidant product and the fuel, and the formation of a suspension or emulsion of the gas in the mixture, adjusting the density of the explosive by controlling the volume of gas.

Optionally, the process may include the addition of a stabilizing solution of the gas bubbles.

The manufacture and sensitization of the explosive by means of the process of the invention may be performed either sequentially, that is, mixing the water based oxidant product with the fuel and later adding the gas, or preferably mixing the water based oxidant product simultaneously with the fuel and the gas.

In the sense used in this description, "on-site manufacturing" refers to the manufacturing and sensitization of the explosive before loading the bores.

The oxidant product consists of a water based liquid mixture that comprises oxidant salts in a solution and in suspension and thickeners to maintain the oxidant particles in suspension.

Oxidant salts that can be employed may be nitrates, chlorates and perchlorates of ammonium, alkaline and alkaline earth metals and their mixtures. Specifically these salts may be, among others, ammonium, sodium, potassium, lithium, magnesium, calcium nitrates, chlorates and perchlorates, or their mixtures. The total concentration of oxidant salts present in the matrix product may vary between 60 and 95% by weight of the formulation of the oxidant product, preferably between 80 and 90%.

Thickening agents that can be employed may be products of inorganic origin of the sepiolite type, or organic such as derivatives from seeds such as guar gum, galactomannans, biosynthetic products such as xanthan gum, starch, cellulose and its derivatives such as carboxymethylcellulose or synthetic polymers such as polyacrylamide. The concentration of thickeners in the oxidizing product may vary between 0.1 and 5% by weight of the formulation, preferably between 0.5 and 2%. In the event of using organic thickeners the concentration must be small enough so that the oxygen balance of the oxidant product is greater than 14%.

Fuels that can be employed may be organic compounds belonging to the group composed of aromatic hydrocarbides, saturated and unsaturated aliphatic hydrocarbides, oils, derivatives of petroleum, derivatives of vegetable origin, such as starches, flours, sawdust, molasses and sugars, or finely divided metallic fuels such as aluminum or ferrosilicates. The preferably used fuels are liquid at room temperature. Generally, the total concentration of fuels in the end explosive may vary between 3 and 20% by weight of the formulation of the end mixture, preferably between 4 and 7%.

The formation of the emulsion or dispersion of gas in the matrix product is performed in an in-line mixer preferably of the dynamic type such as a beater or in a discontinuous mixer preferably of the cement mixer type. The oxidizing product, the fuel, the gas and optionally the bubble stabilizing agent are sent to the mixer by means of their respective dosing devices. In a preferred installation, the feeding of the components is performed through the bottom of a dynamic mixer of the beater type, with the product coming out by overflow over the top.

Gases that can be employed may be those habitually used for sensitizing explosives such as nitrogen, oxygen, air or carbon dioxide. The volumetric ratio between the gas and the mixture of oxidant product and fuels may vary between 0.05 and 5, preferably between 0.1 and 1.

Additionally and optionally stabilizing agents of the gas bubbles may be added, among which are solutions or dispersions of surface actives, proteins and natural polymers and their derivatives. The stabilizing agent may be added in a concentration comprised between 0.01 and 5% by weight of the end formulation, preferably between 0.1 and 2%.

By means of this process an explosive with the adequate density can be manufactured before loading it into the bore, thus allowing to control the quality of the explosive that is being loaded.

Once the explosive is sensitized it can either be sent directly to the bores or a reticulating agent may be added to improve its resistance to water. Among the reticulating agents that may be used are the compositions of antimony such as potassic pyroantimonial, antimony and potassium tartrate, chrome compounds such as chromic acid, sodic or potassic dichromate, zirconium compounds such as zirconium sulfate or zirconium diisopropylamine lactate, titanium compounds such as triethanolamine titanium or aluminum chelate such as aluminum sulfate. The concentration of the reticulating agent may vary between 0.01 and 5% by weight of the formulation, preferably between 0.01 and 2%.

In a particular and preferred embodiment, the process for on-site manufacturing of a water based explosive provided by this invention is carried out in a truck for loading bores which has a tank that contains the water based oxidizing product, a fuel tank, a dosing pump for the oxidizing product, a dosing pump for the fuel and a device for the dosing of gas to the mixer.

The process for on-site manufacturing of a water based explosive provided by this invention has the advantages of transporting a non-explosive precursor product at any temperature, preferably at room temperature, and of allowing to instantaneously vary the density of the on-site manufactured explosive, as well as the size of the air bubbles by means of adjusting the power applied at the mixer. In this way, an end density value of the explosive can be attained by acting upon its sensitivity and detonation speed. Additionally, with the process of the invention the specific amount of explosive necessary for loading the bore may be manufactured. The elevated precision of the method allows to vary the density of the explosive both between bores as well as at one specific bore.

Optionally contemplated is the addition of particulated oxidants or ANFO type explosives, that is, a mixture of particulated oxidant and a hydrocarbide.

The invention also refers to an installation for the on-site manufacturing of water based explosives according to the previously described procedure, such as shown in FIG. 1, which consists of the following:

- a tank (1) for storage of the water based oxidizing product,
- a tank (11) for the storage of fuel,
- a gas reserve (10),
- a mixer (5),
- a pump (3) which connects the oxidizing product tank (1) to the mixer,
- a pump (12) which connects the fuel tank (11) to the mixer,
- a flow-meter (13) to control the addition of fuel, and
- a regulating device (6) of the gas flow and a flow-meter (8).

The mixer (5) can operate continuously and it can be of the dynamic type such as for example a beater or a static mixer. At the mixer's (5) outlet a pump may be placed containing a chute (9) that is used to load the already sensitized explosive in the bores.

Figure 2:
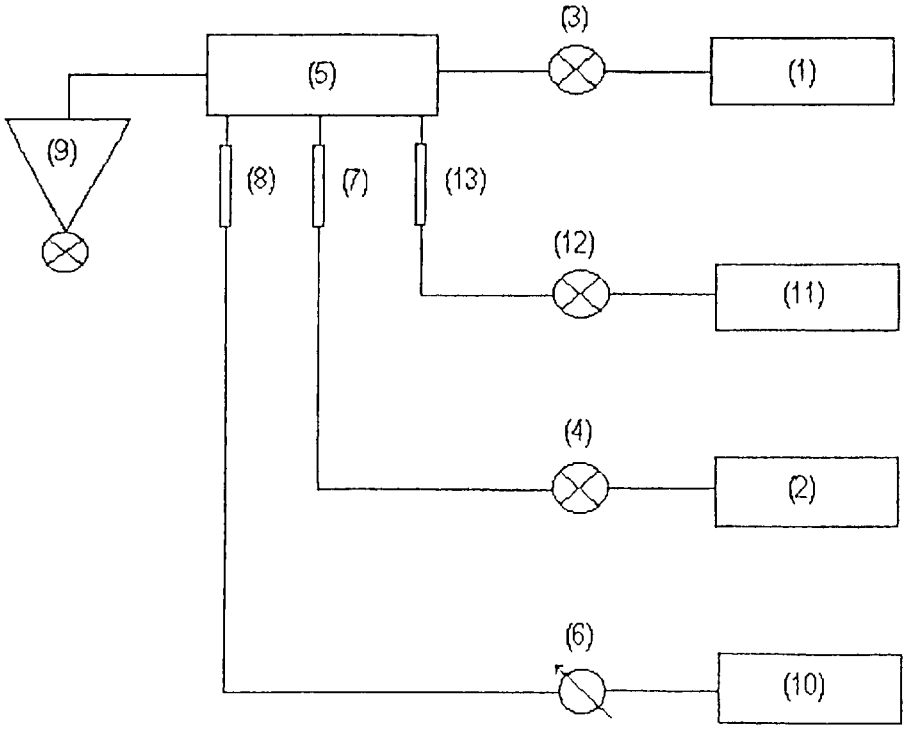
FIG. 2 shows a schematic of another particular embodiment of an installation for the on-site manufacturing of a water based explosive provided by this invention that includes a container for the stabilizer, a dosing pump and a flow-meter.

FIG. 2 shows an alternative embodiment of the installation provided by this invention that is adequate for performing the process in which a stabilizer is added to the mixture of oxidants, fuels and the gas in the mixer. This alternative installation consists of, aside from the previously mentioned equipment, a tank (2) for the storage of stabilizing solution of the gas bubbles, a dosing pump (4) and a flow-meter (7).

In a particular and preferred embodiment, the installation is placed on a truck for loading bores or a pumping truck, which has a tank that contains the water based oxidizing product, a tank containing the fuel, two pumps that dose the oxidizing product and the fuel, a pump for loading the bores and a device for dosing the gas.

The invention is illustrated by means of the following example which in no case is limitative of the scope of the invention.

EXAMPLE

This example describes a type installation and the explosive manufactured in it.

This installation is located on top of a truck which allows the transportation of the oxidizing product and the manufacturing and sensitization at the mine. It consist of the following elements (FIG. 2):

- a 10,000 l tank (1) where the water based oxidizing product is stored;
- a 1,000 l tank (11) where the fuel is stored;
- a 200 l tank (2) for storing the stabilizer;
- three pumps (3, 4 and 12) for transferring the oxidizing product, the stabilizer and the fuel respectively to a mixer (5) of the beater type;
- a valve (6) connected to an air line, for dosing the air to the mixer (5);
- three flow-meters (7, 8 and 13) intercalated between the pump (4), the valve (6), the pump 12 and the mixer (5) to control the flow of stabilizer, air and fuel respectively; and
- a pump containing a chute (9) located at the exit of the mixer (5) used for loading the already sensitized explosive into the bores.

The tank (1) was filled with the formulation of the water based oxidizing product described in Table 1, in which the ammonium nitrate and sodic nitrate particles are in suspension in the water solution saturated with said salts, said suspension being stabilized with the guar gum.

TABLE 1

Composition of the oxidizing product

| Component | % |
|---|---|
| Water | 13.5 |
| Ammonium nitrate | 73.9 |
| Sodic nitrate | 12.0 |
| Guar gum | 0.6 |

The oxygen balance of this formulation of oxidizing product is of +19.6% and its density is 1.51 g/cm$^3$.

In the tank (2) a solution of stabilizer was prepared composed of 90 parts water and 10 parts egg albumin.

The tank (11) was filled with fuel oil.

After the calibration of the dosers the operation began connecting the beater and the different pumps in the conditions described in Table 2.

TABLE 2

Operating conditions and properties of the obtained explosive

| Oxidant kg/min | Fuel oil kg/min | Stabilizer kg/min | Air l/min | Density g/cm$^3$ | Speed m/g |
|---|---|---|---|---|---|
| 150 | 8.7 | 0.5 | 28 | 1.15 | 4400 |
| 150 | 8.7 | 1 | 65 | 0.92 | 3350 |

The already sensitized explosive came out of the mixer (5) by overflow falling on the chute (9) from where it was pumped to the bores, injecting into the hose a reticulated solution of chromic acid at 6% in water.

The values of detonation speed correspond to samples tested in iron pipe of 50 mm interior diameter and initiated with a multiplier of 15 g of pentrite (PETN).

What is claimed is:

1. A process for "in situ" manufacturing of water based explosives, said process comprising the steps of (i) transporting a water based oxidizer product to a loading place for explosives receiving boreholes, and (ii) the manufacture and sensitization of the explosive before the loading of said explosive in the boreholes; wherein said water based oxidizer product has an oxygen balance greater than 14% and it is composed of a saturated aqueous solution of oxidizer salts, oxidizer particles in suspension and thickening agents, said manufacturing and sensitization being performed by mixing in a mixer said water based oxidizer product with a fuel and with a gas stream, so as to form an intimate mixture of said water based oxidizer product and the fuel, and a suspension or emulsion of gas in liquid, and the density of the explosive being adjusted by controlling the gas stream volume.

2. A process according to claim 1, wherein said water based oxidizer product contains between 60% and 95% by weight of oxidizer salts.

3. A process according to claim 1, wherein said water based oxidizer product contains oxidizer salts selected from the group consisting of nitrates, chlorates and perchlorates of ammonium, alkaline and alkaline-earth metals and mixtures thereof.

4. A process according to claim 1, wherein said water based oxidizer product contains between 0.1% and 5% by weight of thickening agents.

5. A process according to claim 1, wherein said water based oxidizer product contains a thickening agent selected from the group consisting of products derived from seeds, biosynthetic products and derivatives thereof, synthetic polymers and thickeners of inorganic origin of the sepiolite type.

6. A process according to claim 1, wherein said fuel is selected from the group consisting of aromatic hydrocarbons, aliphatic hydrocarbons, oils, petroleum derivatives, derivatives of vegetable origin, finely divided metallic fuels, and their mixtures.

7. A process according to claim 1, wherein the explosive obtained contains between 3% and 20% by weight of a fuel.

8. A process according to claim 1, wherein said gas is selected from the group consisting of air, nitrogen, oxygen and carbon dioxide.

9. A process according to claim 1, wherein the volumetric ratio between said gas stream and said mixture composed by said water based oxidizer product and said fuel is comprised between 0.05 and 5.

10. A process according to claim 1, which further includes the addition of a solution for stabilizing gas bubbles.

11. A process according to claim 10, wherein said solution for stabilizing gas bubbles is selected from the group consisting of solutions or dispersions of surfactants, proteins, polymers and derivatives thereof.

12. A process according to claim 10, wherein the explosive manufactured contains up to 5% by weight with respect to the explosive, of a solution for stabilizing gas bubbles.

13. An installation for "in situ" manufacturing of water based explosives, according to the process of any one of claims 1 to 12, which contains at least:

a mixer;

a tank for the storage of the water based oxidizer product;

a pump flow connecting said tank for the storage of the water based oxidizer product to the mixer;

a tank for the storage of the fuel;

a pump flow connecting said tank for the storage of the fuel to the mixer;

a gaseous reserve of gas operatively connected to the mixer; and a gas flow regulating device.

14. An installation according to claim 13, which further contains a tank for the storage of a solution for stabilizing gas bubbles and a pump flow connecting said tank for the storage of the solution for stabilizing gas bubbles to the mixer.

15. An installation according to any one of claims 13 or 14, wherein said mixer is a dynamic type mixer.

16. An installation according to any one of claims 13 or 14, wherein said mixer is a discontinuous mixer.

17. An installation according to any one of claims 13 to 16, said installation being placed on a borehole loading truck.

* * * * *